US008613677B2

(12) United States Patent
Ramey et al.

(10) Patent No.: US 8,613,677 B2
(45) Date of Patent: Dec. 24, 2013

(54) GOLF STANCE INDICATOR

(71) Applicants: Kermit C Ramey, Dunedin, FL (US); Ronnie Phil Ramey, Vermillian, OH (US)

(72) Inventors: Kermit C Ramey, Dunedin, FL (US); Ronnie Phil Ramey, Vermillian, OH (US)

( * ) Notice: Subject to any disclaimer, the term of this patent is extended or adjusted under 35 U.S.C. 154(b) by 0 days.

(21) Appl. No.: 13/860,250

(22) Filed: Apr. 10, 2013

(65) Prior Publication Data

US 2013/0296064 A1 Nov. 7, 2013

Related U.S. Application Data

(60) Provisional application No. 61/642,148, filed on May 3, 2012.

(51) Int. Cl.
*A63B 69/36* (2006.01)

(52) U.S. Cl.
USPC ..... 473/226; 473/257

(58) Field of Classification Search
USPC ..... 473/219, 226, 257, 266, 268; D21/791
See application file for complete search history.

(56) References Cited

U.S. PATENT DOCUMENTS

| | | | | | |
|---|---|---|---|---|---|
| 1,567,530 | A | * | 12/1925 | MacNaughton et al. | 473/229 |
| 2,754,125 | A | | 7/1956 | Engler | |
| 3,269,733 | A | | 8/1966 | Taddie et al. | |
| 3,857,570 | A | | 12/1974 | Gutierrez et al. | |
| 3,953,035 | A | * | 4/1976 | Beckisk | 473/229 |
| 4,133,535 | A | * | 1/1979 | Marsh | 473/229 |
| 5,007,646 | A | | 4/1991 | Baber et al. | |
| 5,037,100 | A | | 8/1991 | Montgomery, Sr. | |
| 5,150,904 | A | | 9/1992 | Sindelar | |
| D331,438 | S | * | 12/1992 | Tucker | D21/791 |
| 6,129,639 | A | | 10/2000 | Brock et al. | |
| 6,551,197 | B1 | * | 4/2003 | Travo | 473/258 |
| 6,702,690 | B1 | | 3/2004 | Albright | |
| 6,755,751 | B2 | | 6/2004 | Chapman | |
| 7,160,201 | B2 | | 1/2007 | Dahl | |

* cited by examiner

*Primary Examiner* — Nini Legesse
(74) *Attorney, Agent, or Firm* — Sinorica, LLC

(57) ABSTRACT

A device for improving a golf stance and swing has a clip, an arm, a mount, and an indicator block. The clip allows the device to be secured to a golf club, while the arm allows the mount and connected indicator block to be centered with respect to the golf club. The mount has a carriage which slides along a corresponding track on the arm, and a perpendicular rod about which the indicator block can rotate. The indicator block has three faces, two lateral faces and a top face. When the indicator block is centered on a head of a golf club, it can be used to gauge the correct distance from the ball a golfer should stand. Only the top face of the indicator block will be visible when standing the correct distance from the ball. The faces of the indicator block are color coded to increase usability.

20 Claims, 17 Drawing Sheets

GOLF STANCE INDICATOR

The current application claims a priority to the U.S. Provisional Patent application Ser. No. 61/642,148 filed on May 3, 2012.

FIELD OF THE INVENTION

The present invention relates generally to a device that aids golfers in improving their putting by encouraging a proper stance and pendulum motion during the swing, ultimately leading to a lower golf score.

BRIEF DESCRIPTION OF THE PRIOR ART

Putting training aids are well known as illustrated by U.S. Pat. Nos. 3,857,570, 6,129,639, 2,754,125, 5,037,100, 6,755,751, 5,007,646, 3,269,733, 6,702,690, 5,150,904, and 7,160,201. Each of these devices is designed to change the golfers putting stroke to that of a pendulum swing. In general the above patents recommend the use of a metal frame, a heel or toe guide, or a shaft guide to direct the putter along a straight line along the back and forward swing.

The "Eyes-Over-the-Ball" putting aid offers a new and novel approach, different from the above, on correcting poor putting strokes. The first step is to evaluate the golfers putting stance. Secondly, the device leads the golfer to the correct stance—that is the eyes are directly over the ball or in the vicinity thereof. This position with the eyes over the ball allows and encourages the golfer to swing the putter back and forth in a straight line. Furthermore most golfers will be able to accomplish the transition from an arc swing to that of a pendulum swing and they do not need the frames or guides that are costly and cumbersome to use.

The "Eyes-Over-the-Ball" putting aid teaches the amateur golfer to diagnosis his or her stance problem via a color coded stance evaluator, while prior art does not cover this area. The device leads the golfer to the correct stance, and it provides a vehicle for the golfer to practice swinging the putter with a motion that approaches a straight back and straight forward motion. The stance is the key element in the conversion from an arc putter swing to a pendulum swing and in turn, an improvement in putting.

Previous patents do not cover diagnosing the golfer's stance problems and how to correct them, but rather jump to the solution, that is, how to generate a putter stroke that follows a pendulum motion. Furthermore they require a frame for the complete stroke, both heel and toe or shaft guides to accomplish this end.

We contend that most golfers will be able to swing the putter in a pendulum motion, if their putting stance problems are identified, corrections applied, and a vehicle is provided that returns them to the correct position for each stroke. There is a distinct possibility that the frames and guides suggested by the previous patents will slow down or inhibit the overall progress of a golfer as they change from an arc swing to that of a pendulum swing.

BACKGROUND OF THE INVENTION

Golf is a sport enjoyed by many people, including a large number of amateurs who have yet to master the basics of golfing. Putting, in particular, proves to be a challenge for many amateur golfers. A proper putting stance will position a golfer's eyes over the ball, while the swing will ideally have minimal opening on the back and forward swing, following a pendulum stroke. While most golfers exhibit a stance that is too far from the ball, there are some that tend to stand too close to the ball. Despite various aids to improve their putting, many amateur golfers do not keep their eyes over the ball and swing in an arc motion, with large arc-openings on the front and back swing. These issues are linked; when the eyes are off center (from as little to one inch and past six inches), the subsequent stroke opens along the back and front swing, forming an arc motion when viewed from above. While this can result in good contact with the ball, it requires hitting the ball at the center of the stroke, such that the putter face is perpendicular to the intended putting line. Conversely, when the eyes are correctly positioned directly over the ball, the golfer is encouraged to swing the putter back and forth along a straight line.

A more likely result of an arc swing is that the putter face strikes the ball before or after the center of the stroke, resulting in the ball travelling to the left or right of the intended putting line. Related to the stance, numerous other factors affect a golfer's swing, including the length of the putter (often they are too long), the wingspan of the golfer, and the position of the hands on the putter. Since putting represents 50% of the golf game, perfecting the stance and related issues provides a huge boost to an amateur's game. To improve one's putting, focus must be placed on distance and direction. Distance is a function of the subconscious, as it is based on how much force a golfer applies to the stroke. Direction depends on multiple factors, such as the slope of the green and the stroke. The slope of the green is an external factor, and in a sense cannot be "corrected". The stroke, however, is a key ingredient of putting and can be corrected. While different persons have different natural strokes, ranging from figure eights to straight lines, the ideal stroke is the straight line or "pendulum stroke".

The prior art, rather than allowing the golfer to assume a natural stance and stroke, artificially force the golfer into the proper stance and stroke. While these solutions work for some, they are avoided by others for numerous reasons, mainly that they are too cumbersome and costly. Some amateurs eschew these solutions because they view the solutions as too complex or simply believe that their stroke needs no improvement. There exists a need for an inexpensive, simple, and convenient apparatus for improving one's putting stance and stroke.

It is therefore an object of the present invention to provide an apparatus that provides color-coded visual cues to indicate if a golfers stance is too close, too far, or properly distanced from a ball. It is a further object of the present invention to improve a golfer's putting by improving their stance and swing. It is a further object of the present invention to help a golfer correct an arc putter swing to the ideal pendulum putting swing.

DETAIL DESCRIPTIONS OF THE INVENTION

All illustrations of the drawings are for the purpose of describing selected versions of the present invention and are not intended to limit the scope of the present invention.

Figure 1:
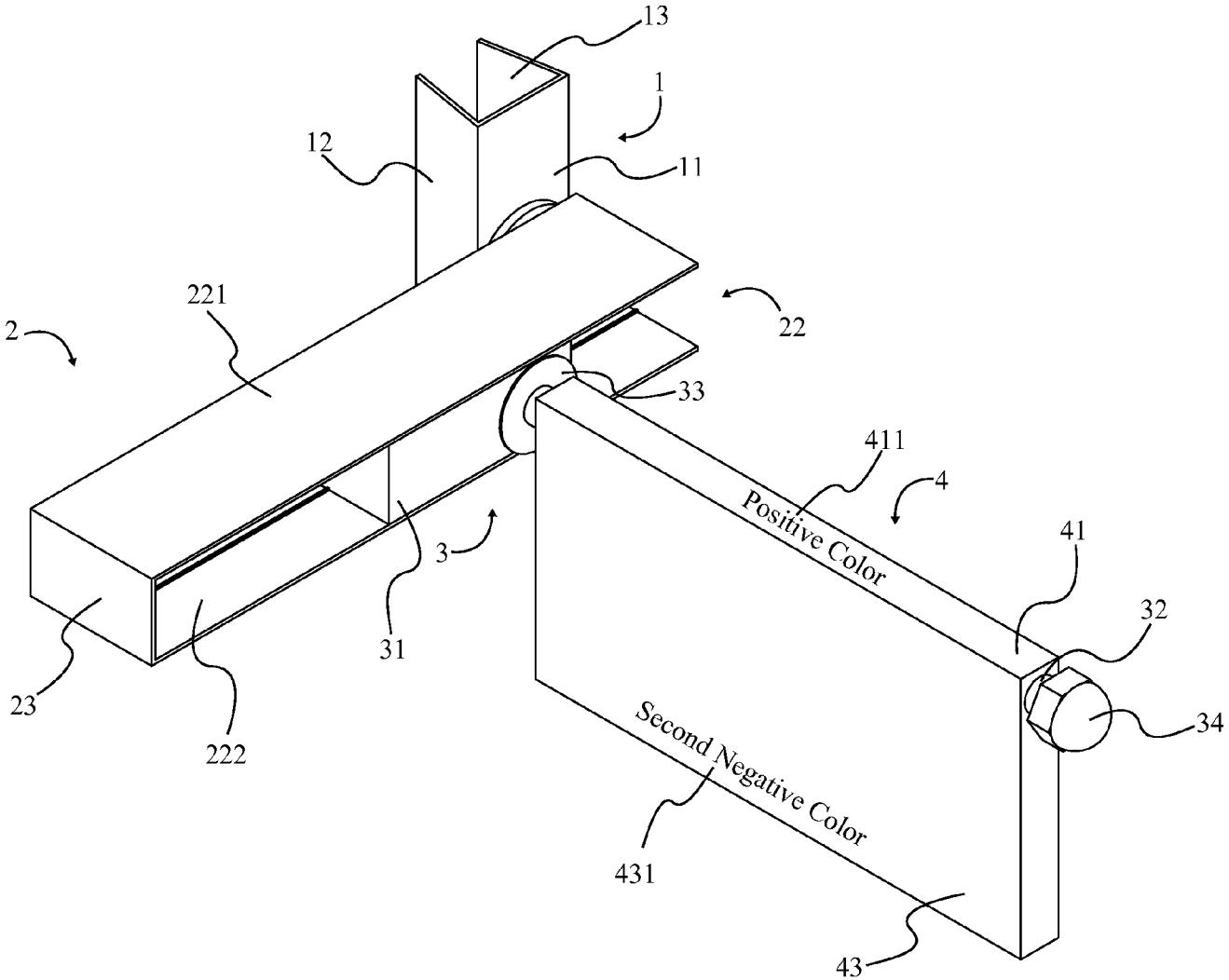
FIG. 1 is a perspective view of the present invention.
Figure 2:
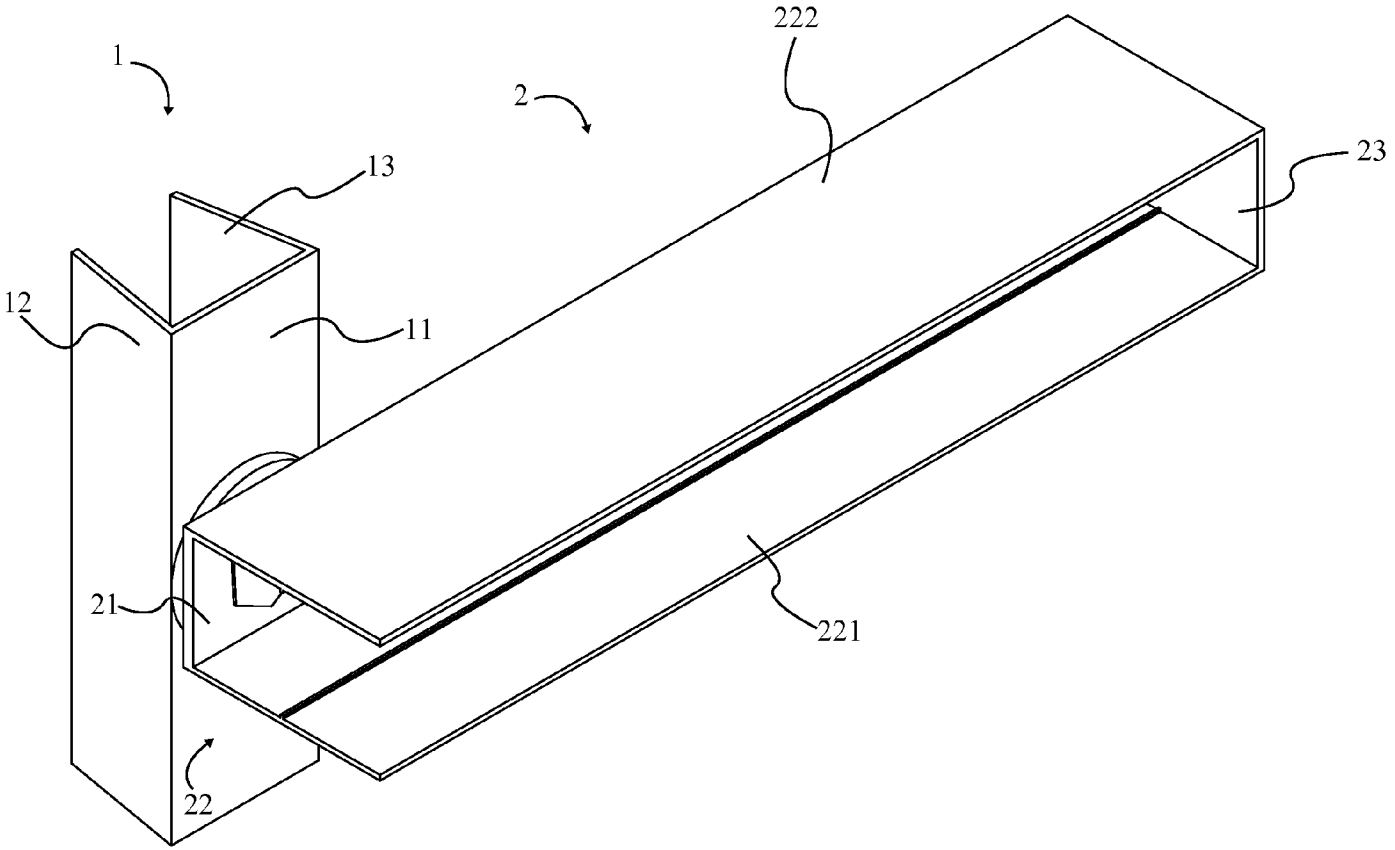
FIG. 2 is a perspective view of the clip, arm, and spring-loaded axle of the present invention.

The present invention is a tool for aiding a golfer in improving their putting stance and swing. The present invention provides visual cues to help a golfer check their distance from the ball. The present invention comprises a clip 1, an arm 2, a mount 3, an indicator block 4, and a spring-loaded axle 5, all of which minus the spring-loaded axle are depicted in FIG. 1. The clip 1 secures the present invention to a golf club 6. The indicator block 4 is connected to the arm 2 by the mount 3. The arm 2 is used to create clearance between the indicator block 4 and the clip 1.

Figure 6:
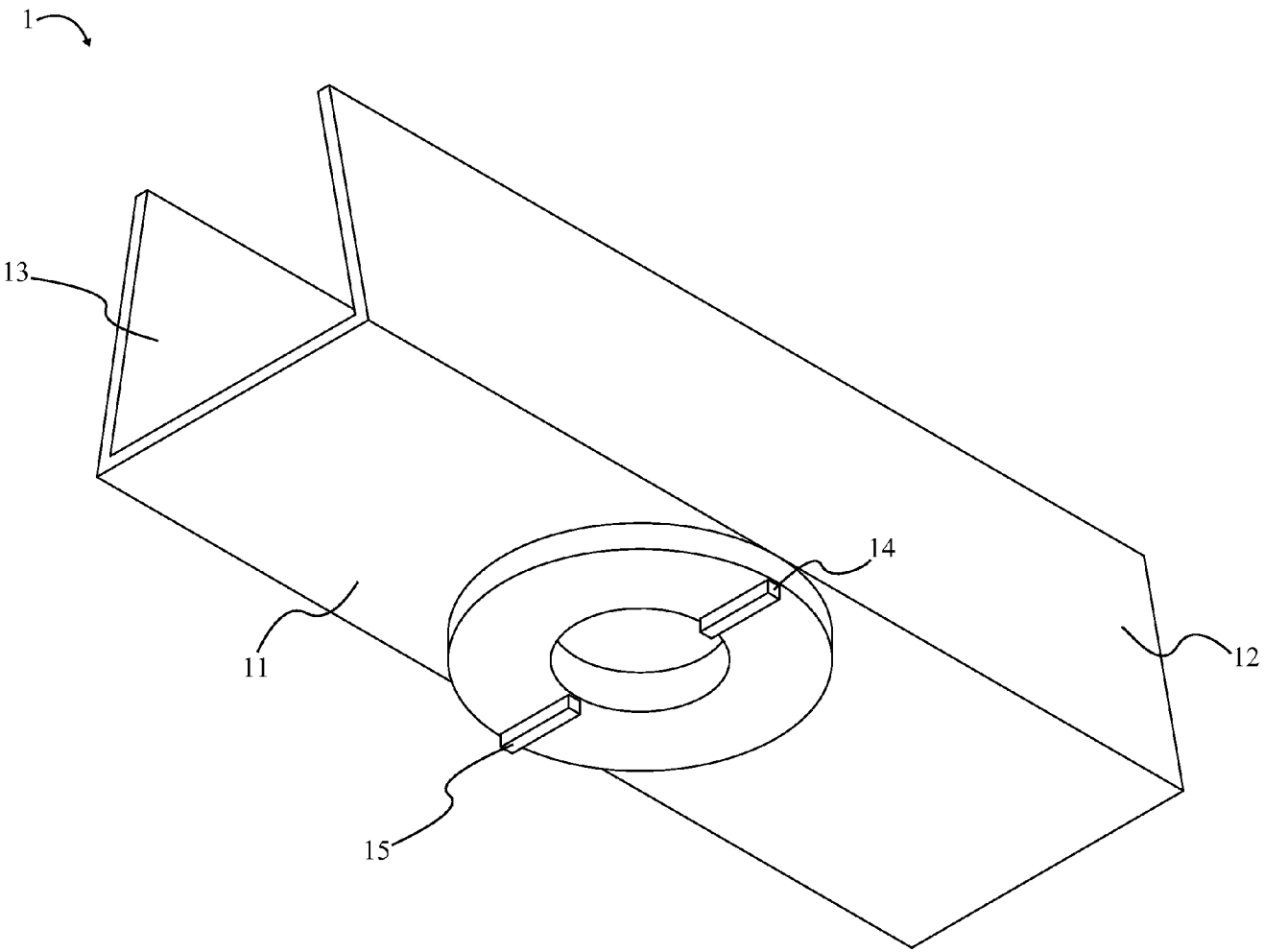
FIG. 6 is bottom perspective view of the clip of the present invention.
Figure 7:
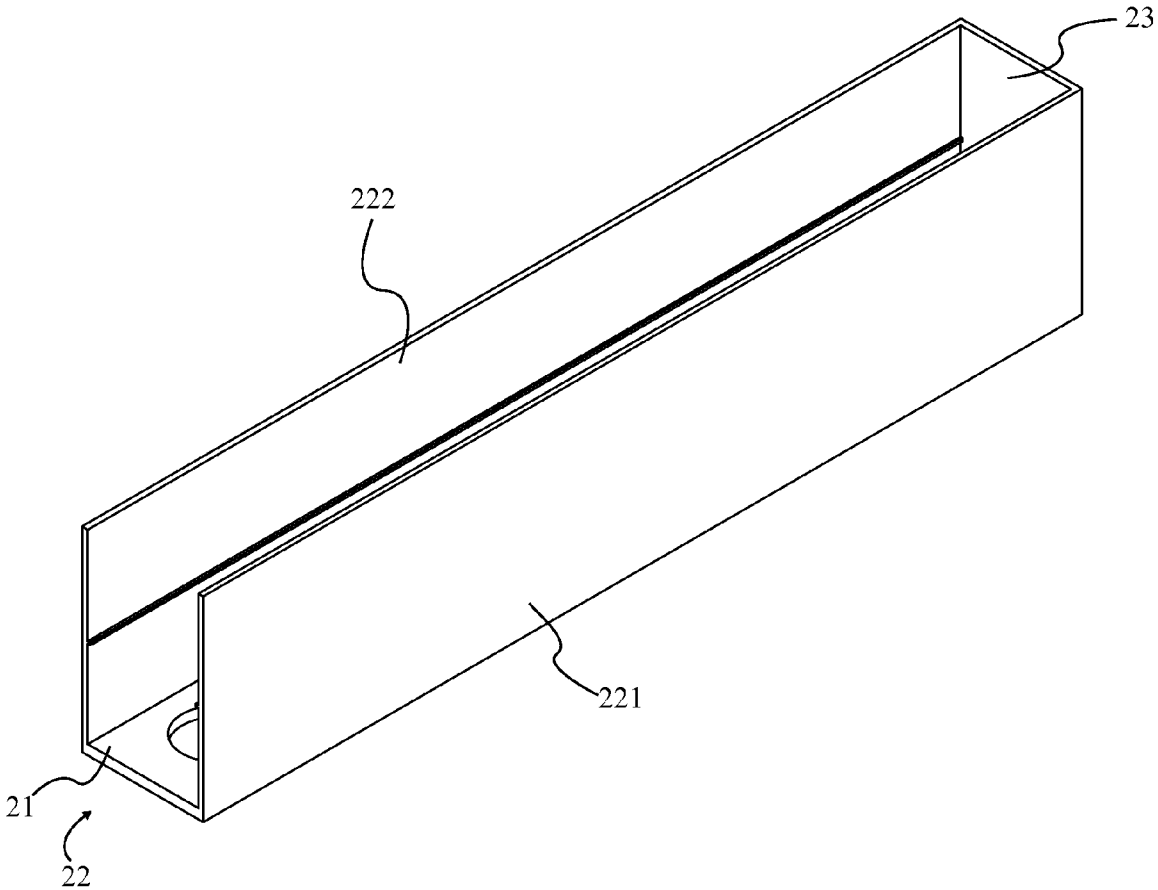
FIG. 7 is a perspective view of the arm of the present invention.
Figure 8:
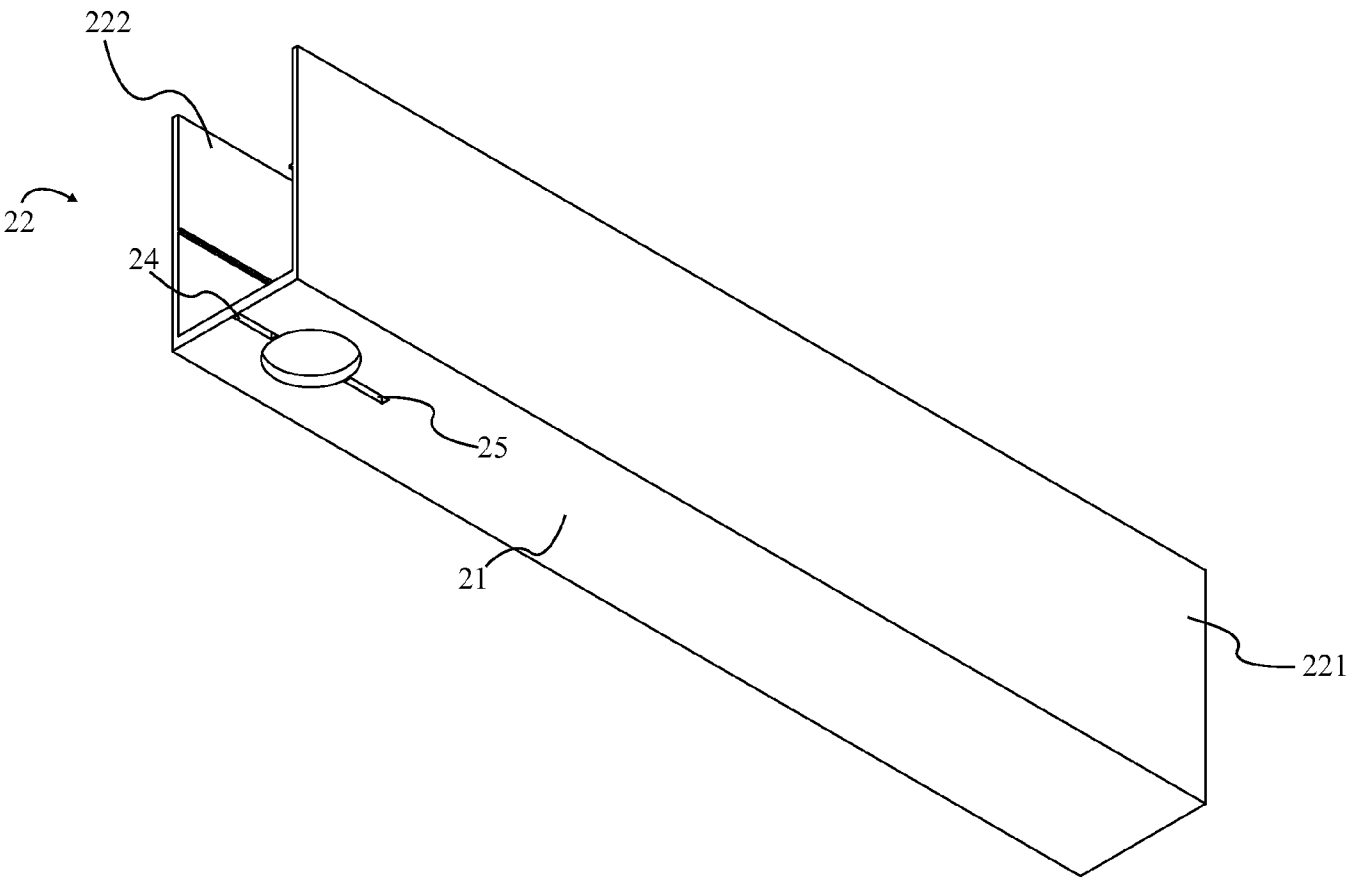
FIG. 8 is a bottom perspective view of the arm of the present invention.

Visible in FIG. 1-FIG. 6, the clip 1 comprises a web 11, a first jaw 12, a second jaw 13, a first ridge 14, and a second ridge 15. The first jaw 12 and the second jaw 13 are connected to the web 11, with the first jaw 12 and second jaw 13 each being connected along a long edge of the web 11. The first jaw 12 and the second jaw 13, as seen in FIG. 6, are positioned opposite each other across the web 11, creating a space between the first jaw 12 and the second jaw 13 which is designed to receive the shaft 61 from a golf club 6. Connected to the web 11, on the face opposite the first jaw 12 and second jaw 13, is the first ridge 14 and the second ridge 15. The first ridge 14 and the second ridge 15 are positioned on the main body next to the face which is opposite the first jaw 12 and the second jaw 13. The first ridge 14 and the second ridge 15 are oriented to be perpendicular to the length of the web 11. The first ridge 14 and the second ridge 15 are designed to engage with matching components on the arm 2.

In the preferred embodiment, the first jaw 12 and the second jaw 13 utilize an interference fit to secure the clip 1 to the shaft 61 of a golf club 6. In other embodiments, variations of this attachment may be pursued, such as using a clamp. However, while other methods of securing the clip 1 are possible, the interference fit provides an inexpensive, simple, and user-friendly way of securing the clip 1. It is for these reasons that the interference fit is utilized by the preferred embodiment.

The arm 2, which is connected to the clip 1 in one of two stable configurations, comprises a floor 21, a track 22, a stop 23, a first notch 24, and a second notch 25. The arm 2 is illustrated in FIG. 1-FIG. 4, FIG. 7, and FIG. 8. The track 22 itself comprises a first rail 221 and a second rail 222. The track 22 is positioned lengthwise along the arm 2, forming a guide for the mount 3 to slide along. The floor 21 holds the first rail 221 and the second rail 222 in place, with the first rail 221 and second rail 222 each being positioned along separate long edges of the track 22. The first rail 221 and second rail 222 are positioned opposite each other across the track 22, forming a pathway for the mount 3 to travel along. This pathway for the mount 3 is delineated by the floor 21, the first rail 221, and the second rail 222. Positioned at one end of the arm 2, opposite the clip 1, is the stop 23. The stop 23 is connected to the track 22 and creates a barrier in the pathway, preventing the mount 3 from sliding past the end of the track 22 and off the arm 2 altogether. The first notch 24 and the second notch 25 are connected to the floor 21, next to the face which is opposite the track 22. The first notch 24 and second notch 25 are oriented to be parallel to the length of the track 22, such that when the first notch 24 and second notch 25 are engaged with the first ridge 14 and the second ridge 15, the clip 1 will be perpendicular to the arm 2.

Potentially, a second barrier could be connected to the open end of the track 22, thus securing the mount 3 between the stop 23 and the second barrier. While this would greatly reduce the possibility of accidently sliding the mount 3 off the track 22, it would also make accessing or replacing the mount 3 much more difficult. Whether an embodiment employs the second barrier or not, the general function of the arm 2 remains the same, allowing the arm 2 to be effectively used as part of the present invention.

Figure 3:
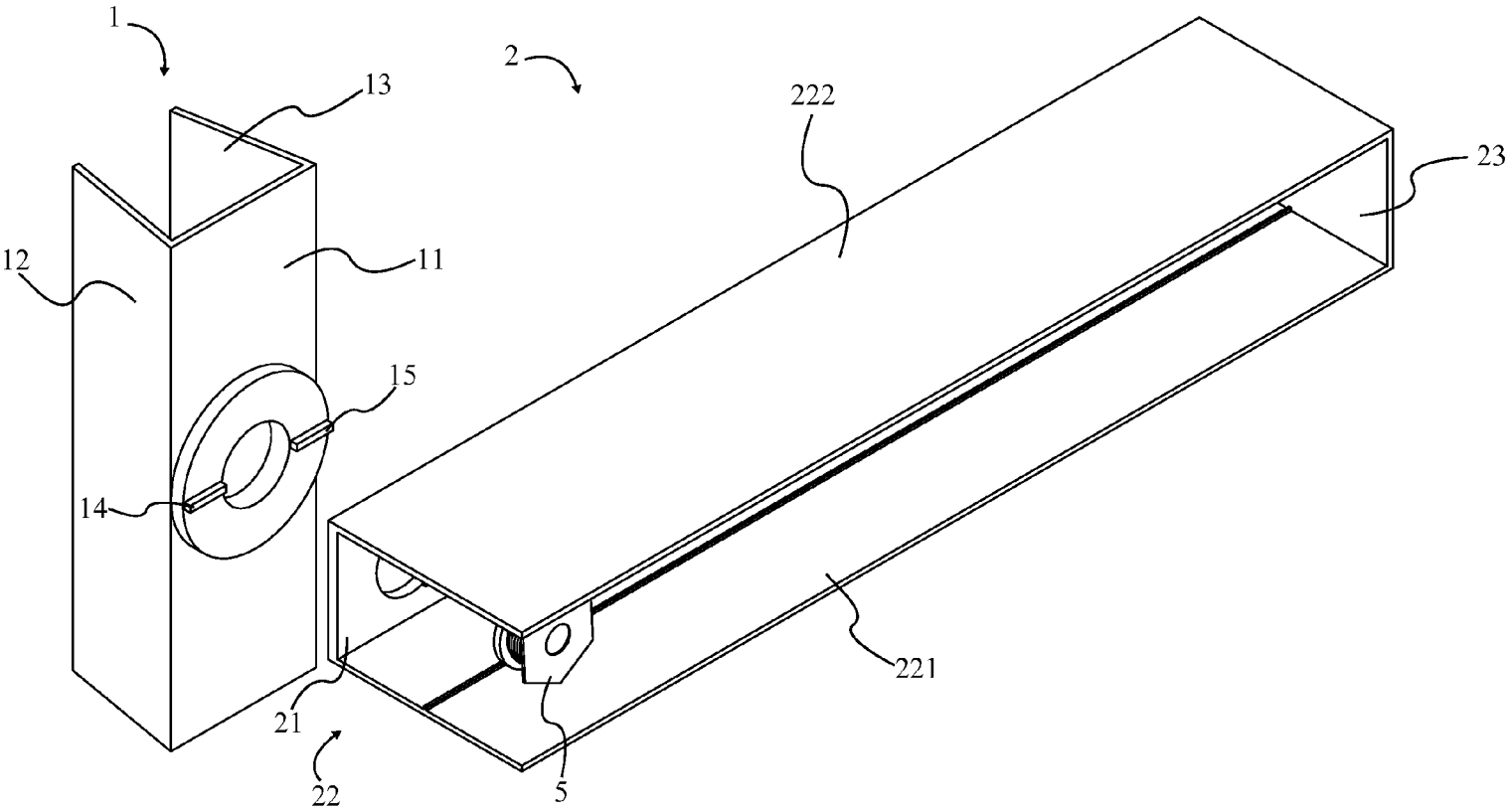
FIG. 3 is an exploded perspective view of the clip, arm, and spring-loaded axle of the present invention.
Figure 4:
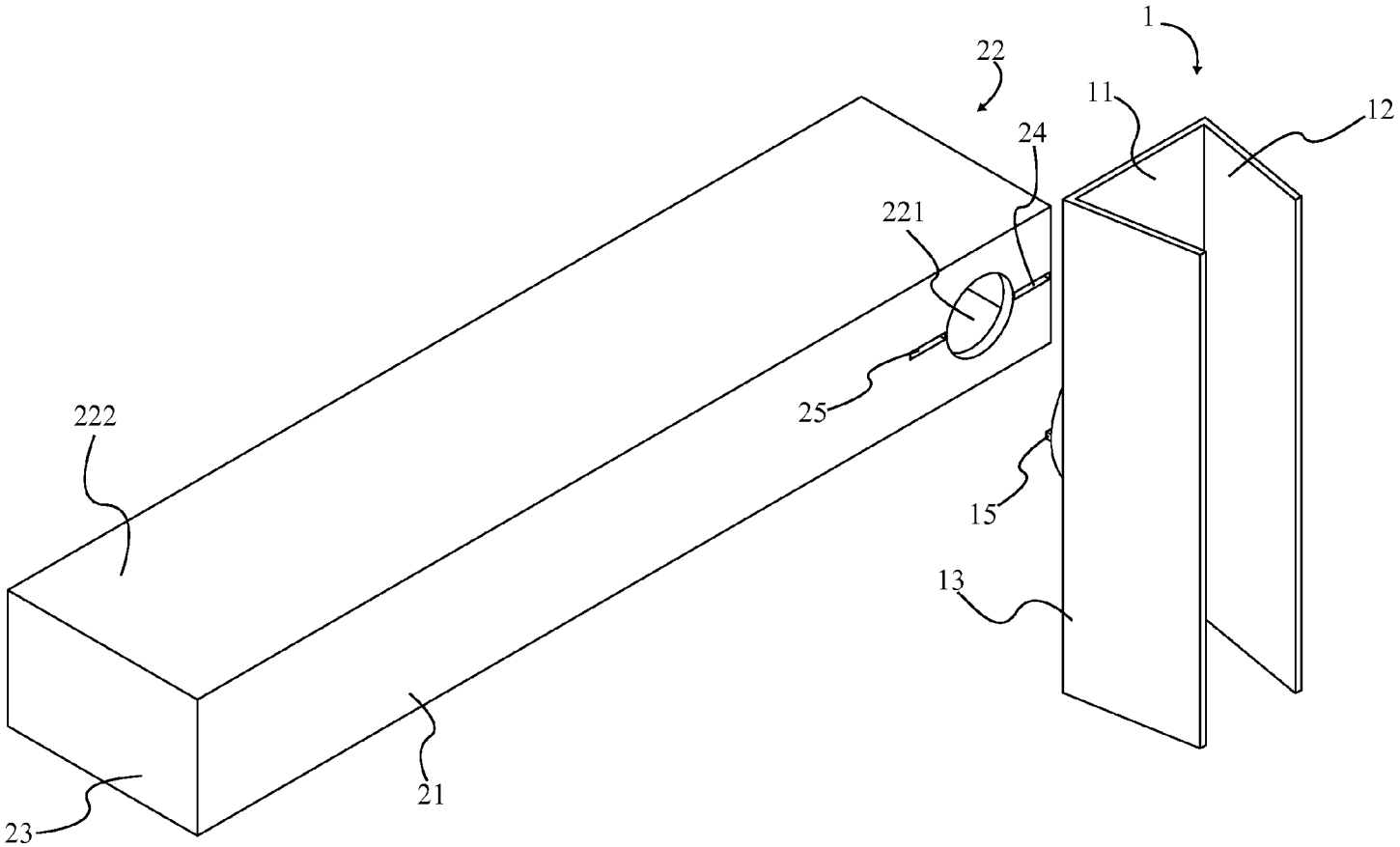
FIG. 4 is a rear exploded view of the clip and arm of the present invention.
Figure 5:
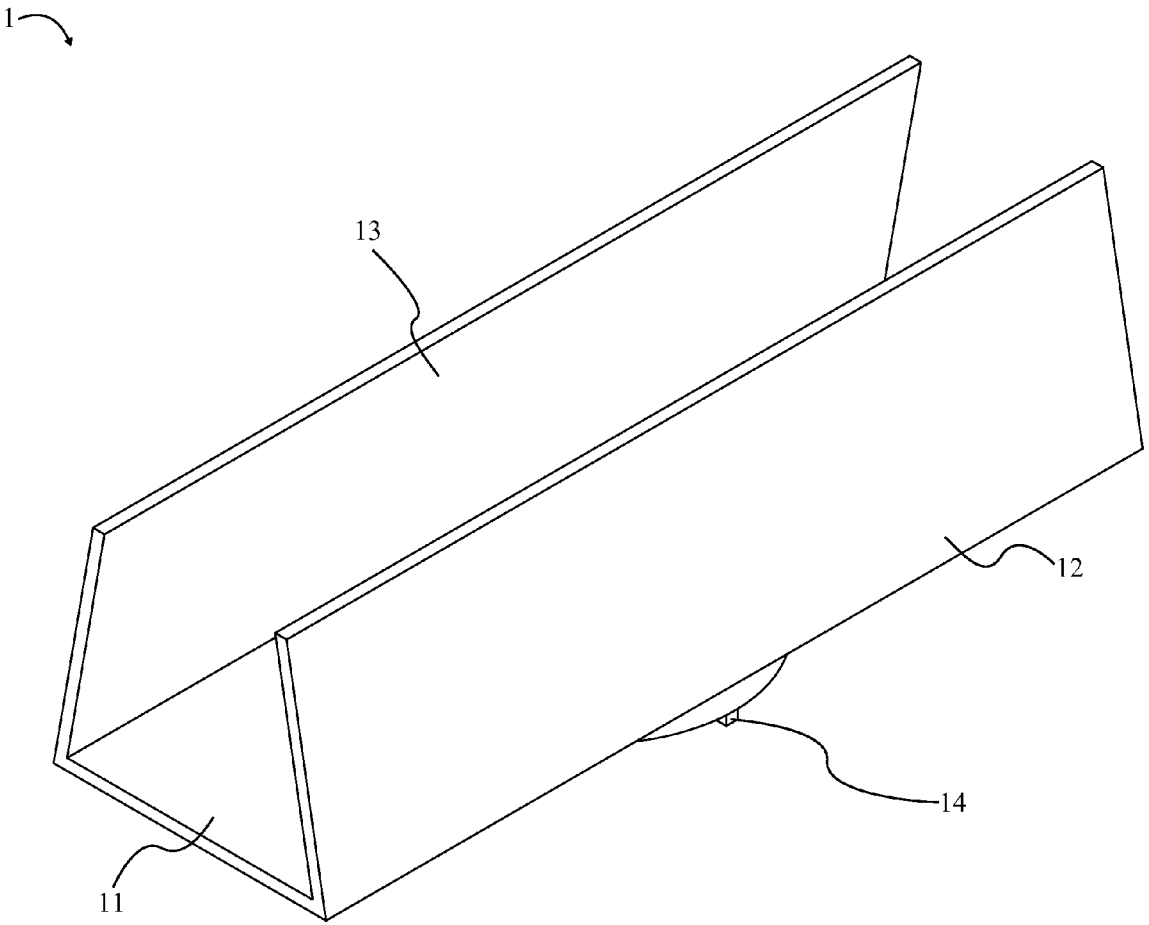
FIG. 5 is perspective view of the clip of the present invention.

Securing the arm 2 to the clip 1 is the spring-loaded axle 5, seen in FIG. 3. In combination with the first ridge 14, second ridge 15, first notch 24, and second notch 25, the spring-loaded axle 5 allows the arm 2 to rotate between two positions with respect to the clip 1. The spring-loaded axle 5 traverses through the floor 21 and into the web 11, adjacent to the open end of the arm 2. The first ridge 14 and the second ridge 15 (which are connected to the web 11) are laterally positioned around the spring-loaded axle 5, with each ridge being normal to the arc of the spring-loaded axle 5. The first ridge 14 and the second ridge 15 are further defined as being perpendicular to the length of the spring-loaded axle 5 and being arranged opposite each other around the spring-loaded axle 5. Similar to the first ridge 14 and the second ridge 15, the first notch 24 and the second notch 25 are laterally positioned around the spring-loaded axle 5. In addition, the first notch 24 and the second notch 25 are perpendicular to the length of the spring-loaded axle 5 and perpendicular to the length of the spring-loaded axle 5, again mirroring the arrangement of the first ridge 14 and the second ridge 15.

Figure 14:
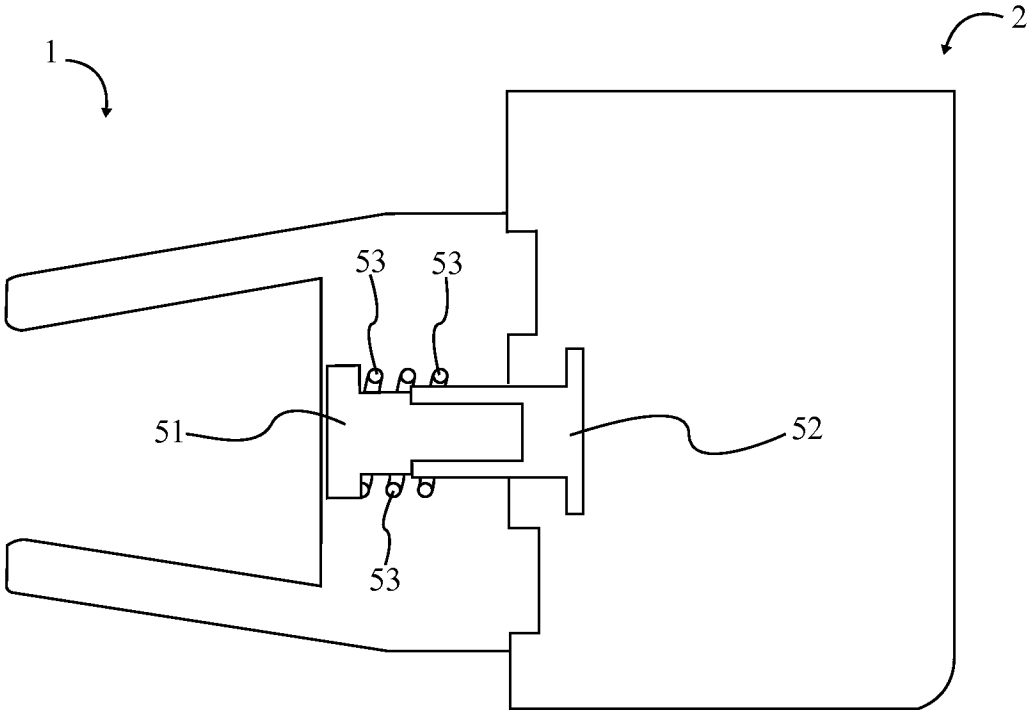
FIG. 14 is an internal view showing the construction of the spring-loaded axle of the present invention.

The spring-loaded axle 5 can be assembled in a number of ways, an example of which is shown in FIG. 14. In this view, it is seen that the spring-loaded axle 5 comprises a screw 51, a nut 52, and a spring 53. The screw 51 is inserted through the clip 1 and the arm 2, with the spring 53 being wrapped around the screw 51. To secure the screw 51 in place, the nut 52 is attached to the screw 51, such that the nut 52 is flush with the web 11 of the clip 1.

Figure 9:
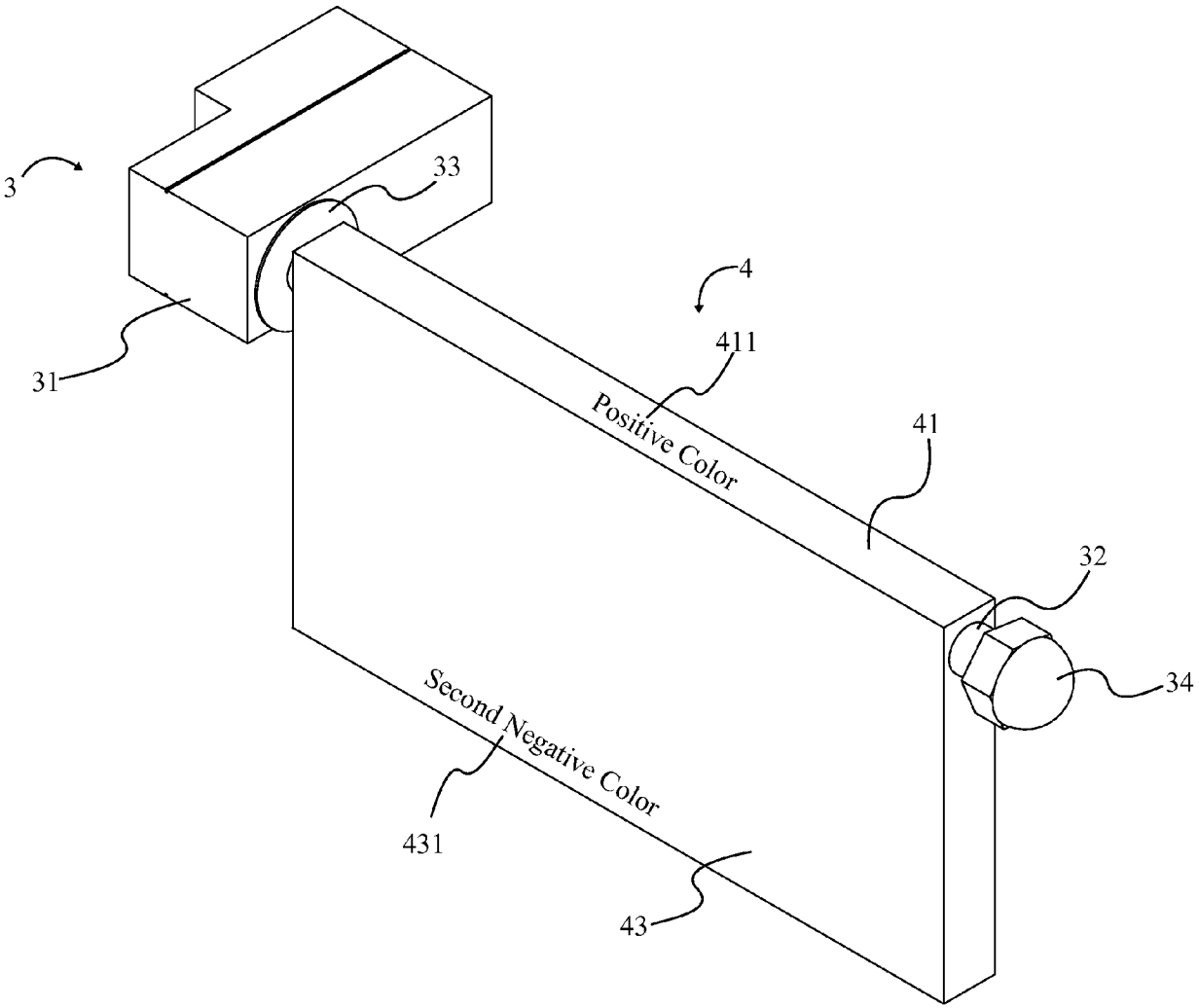
FIG. 9 is a perspective view of the mount and indicator block of the present invention.
Figure 10:
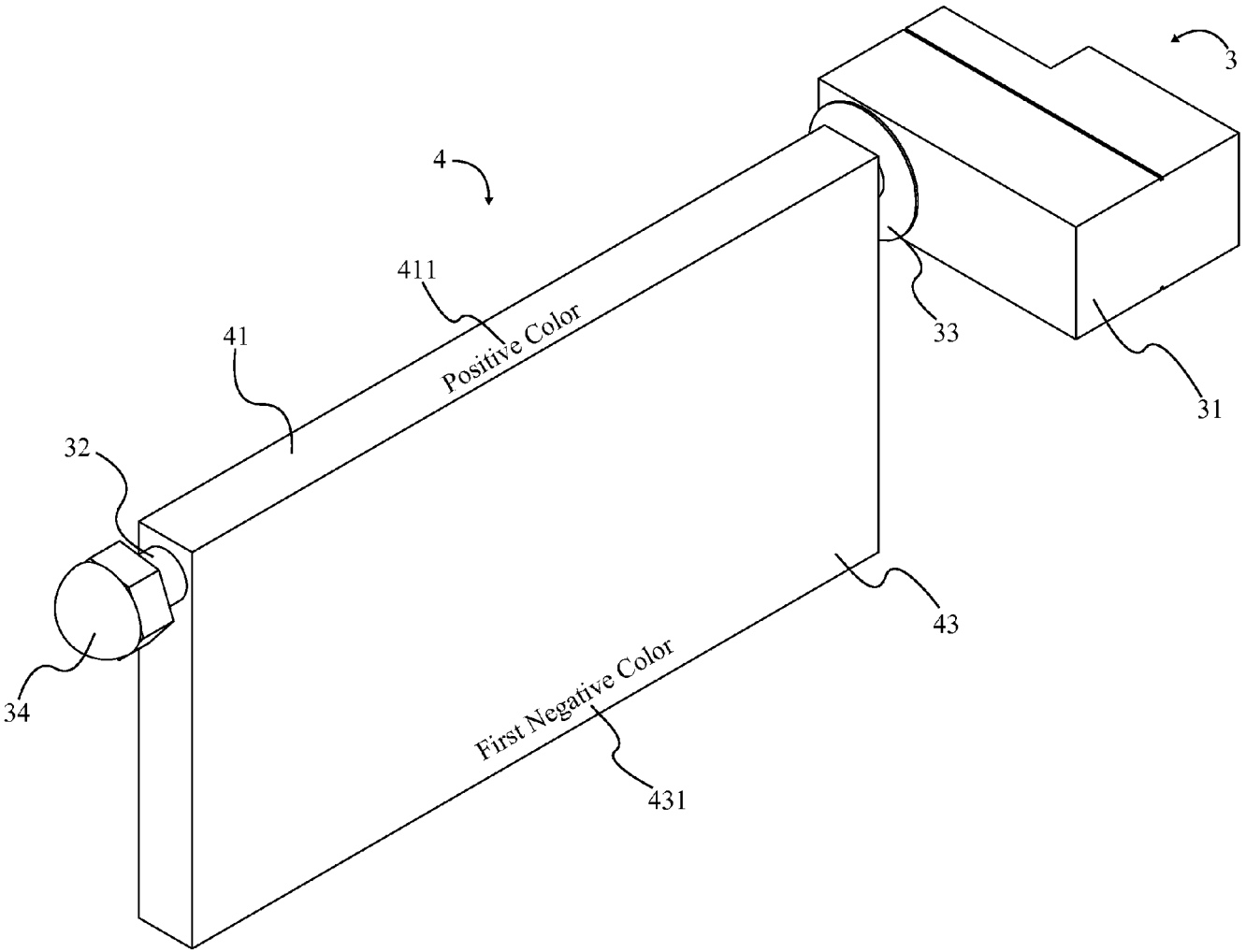
FIG. 10 is a rear perspective view of the mount and indicator block of the present invention.
Figure 11:
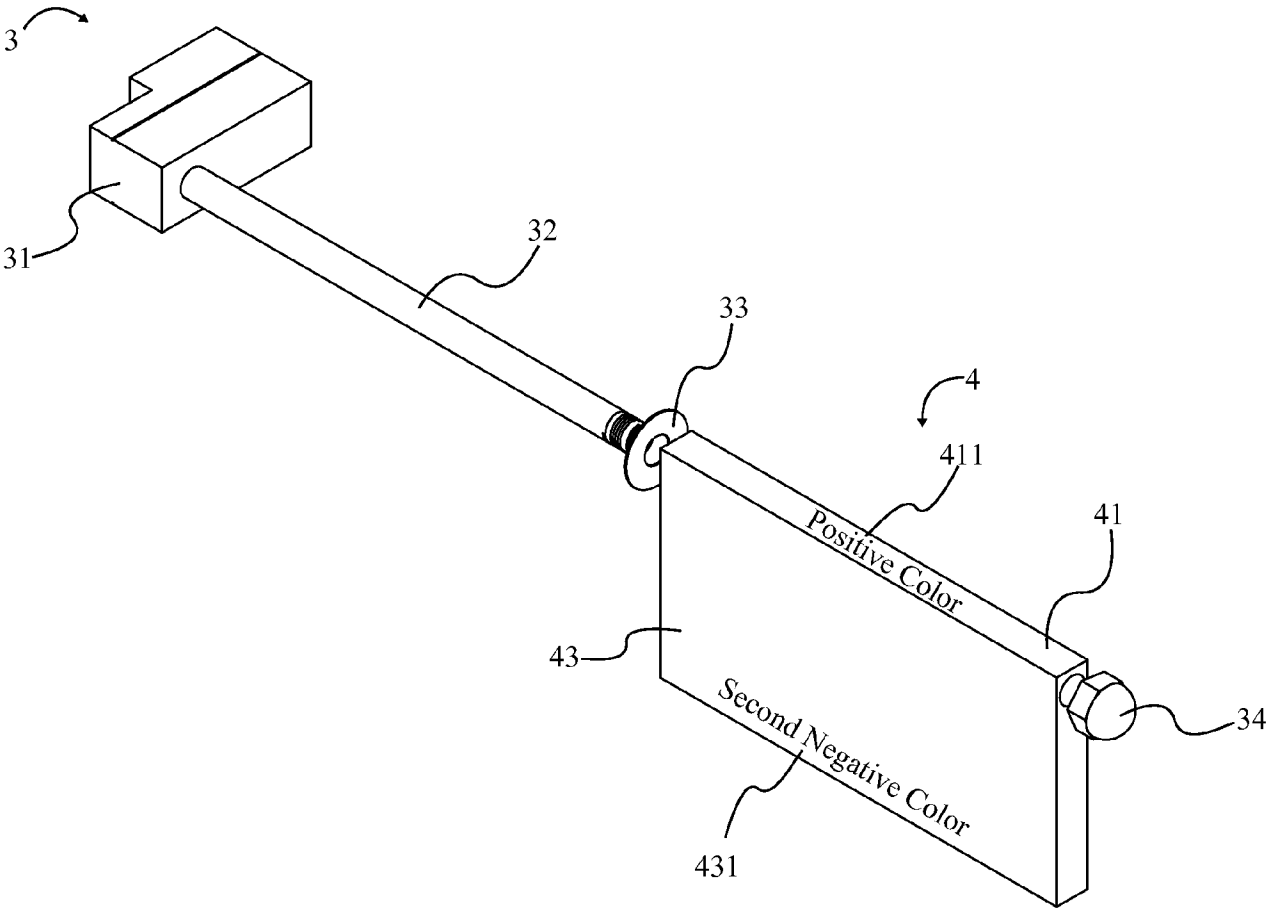
FIG. 11 is an exploded view of the mount and indicator of the present invention.
Figure 12:
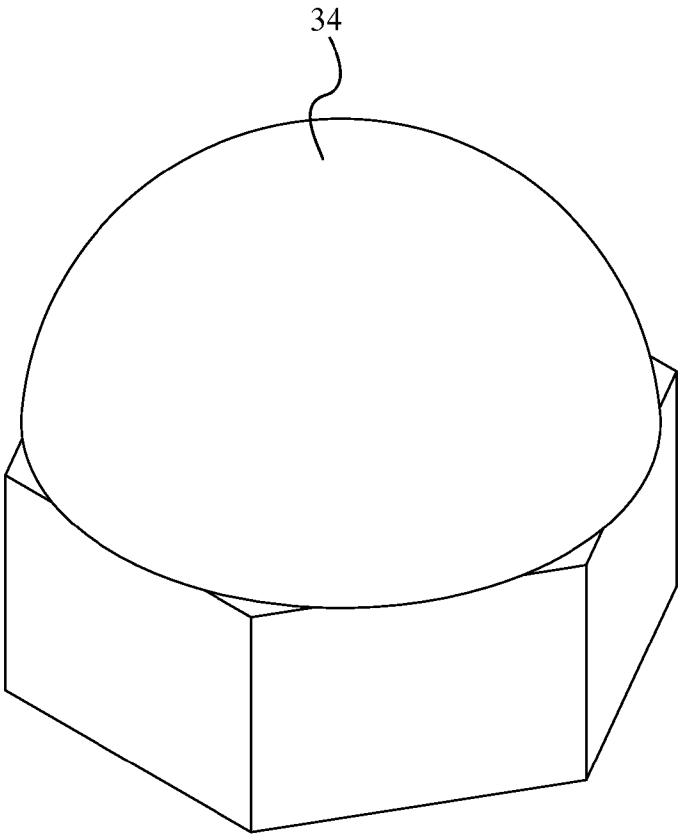
FIG. 12 is a perspective view of the cap of the present invention.
Figure 13:
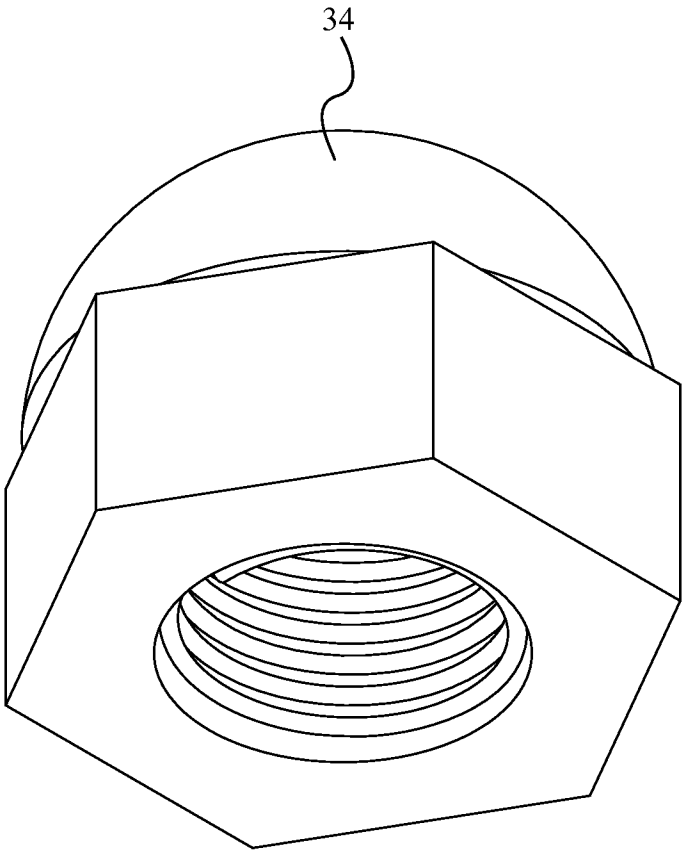
FIG. 13 is a bottom perspective view of the cap of the present invention.

The mount 3 comprises a carriage 31, a rod 32, a spacer 33, and a cap 34, as shown in FIG. 9-FIG. 11. The carriage 31 is slidably engaged with the track 22, such that it can move along the pathway formed by the floor 21, first rail 221, and second rail 222. Connected to the carriage 31 is the rod 32, which is oriented to be perpendicular to the track 22. The rod 32 is designed to support the indicator block 4, as explained later. To allow the indicator block 4 to rotate around the rod 32 without catching against the carriage 31 or sliding off the rod 32, the spacer 33 and cap 34 are utilized. The spacer 33, which encircles the rod 32, is positioned next to the carriage 31. This creates a small gap between the indicator block 4 and the carriage 31, allowing the indicator block 4 to rotate freely without obstruction. At the other end of the rod 32, opposite the spacer 33, is the cap 34 (fully visible in FIG. 12 and FIG. 13). The cap 34 is attached to the rod 32, such that the cap 34 may be removed in order to pull the indicator block 4 off of the rod 32. Preferably this is done by a threaded connection between the rod 32 and cap 34, which is visible in FIG. 11 and FIG. 13.

The indicator block 4 comprises a top face 41, a first lateral face 42, a second lateral face 43, and a channel 44, as seen in FIG. 9-FIG. 11. The first lateral face 42 and second lateral face 43 form opposite sides of the indicator block 4, and are positioned perpendicular to the top face 41. Cutting a hole through the indicator block 4 is the channel 44, which is positioned just below the top face 41 and between the first lateral face 42 and the second lateral face 43. The channel 44 allows the indicator block 4 to be rotatably connected to the carriage 31, by means of the rod 32 traversing through the channel 44. The top face 41, first lateral face 42, and second lateral face 43 are especially important to the function of the present invention as they provide visual cues to help a golfer improve their putting stance. The top face 41, designed with a first color 412 as the visual cue, acts as a positive feedback indicator 411. The first lateral face 42, designed with a second color 422 as the visual cue, acts as a first negative feedback indicator 421. Similarly, the second lateral face 43, designed with a third color 433 as the visual cue, acts as a second negative feedback indicator 431.

In the preferred embodiment the visual cues are color based, since different colors are easily recognizable and processed by a user. The colors used in the preferred embodiment are green for the top face 41, yellow for the first lateral face 42, and red for the second lateral face 43. While other embodiments could use different colors or different visual cues (such as differing striped patterns), the simplicity of colors leads to them being utilized in the preferred embodiment. However, other embodiments can use any type of cue, even audio, as long as it serves the function of indicating a correct or incorrect putting stance.

The present invention is designed to attach to the shaft 61 of a golf club 6, and is usable for both left-handed golfers and right-handed golfers, depending on which end of the shaft 61 the clip 1 is attached to. The spring-loaded axle 5 allows the arm 2 to rotate 180 degrees between two stable positions. By rotating the arm 2, the spring-loaded axle 5 is put into extension. While in extension, the spring wants to return to its equilibrium position, creating a force that pulls the floor 21 and web 11 together. In areas where the floor 21 and the web 11 are flat, this force is not strong enough to prevent rotation; thus, the arm 2 can be rotated between the stable positions. However, when the first ridge 14 is aligned with the first notch 24 and the second ridge 15 is aligned with the second notch 25, the force created by the extended spring compresses the spring and pushes the ridges into their aligned notches. This prevents further rotation of the arm 2 unless the spring is again extended, which disengages the ridges from the notches. The spring constant of the spring will be high enough to prevent the ridges and notches from disengaging from each other during regular use, such as golfing, but low enough that a person can easily extend the spring in order to switch between the two stable configurations. The first stable configuration occurs when the first ridge 14 aligns with the first notch 24 and the second ridge 15 aligns with the second notch 25. The second configuration, which rotates the arm 2 180 degrees with respect to the first configuration, occurs when the first ridge 14 aligns with the second notch 25 and the second ridge 15 aligns with the first notch 24.

The present invention is designed to help a golfer correct their putting stance and stroke. More specifically, the present invention helps golfers stand the correct distance from the golf ball and swing the putter in a straight line, rather than a slightly curved swing that afflicts many amateurs. The present invention is secured to a the shaft 61 of a golf club 6 by means of the clip 1. The present invention is designed to be secured so that the clip 1 is attached to the rear section of the shaft 61, such that the arm 2 faces a rearward direction. For a right-handed golfer, this means the arm 2 should be pointing towards the right of the club, while a left-handed golfer will have the arm 2 pointing towards the left of the club. This orientation is important as it does not interfere with the ball during putting; if the arm 2 faced the front of the golf club 6 then the present invention would hit the golf ball during the swing. If the clip 1 is connected properly, the rod 32 and indicator block 4 will not only be perpendicular to the track 22, they will also be perpendicular to the head of the golf club 6.

Figure 15:
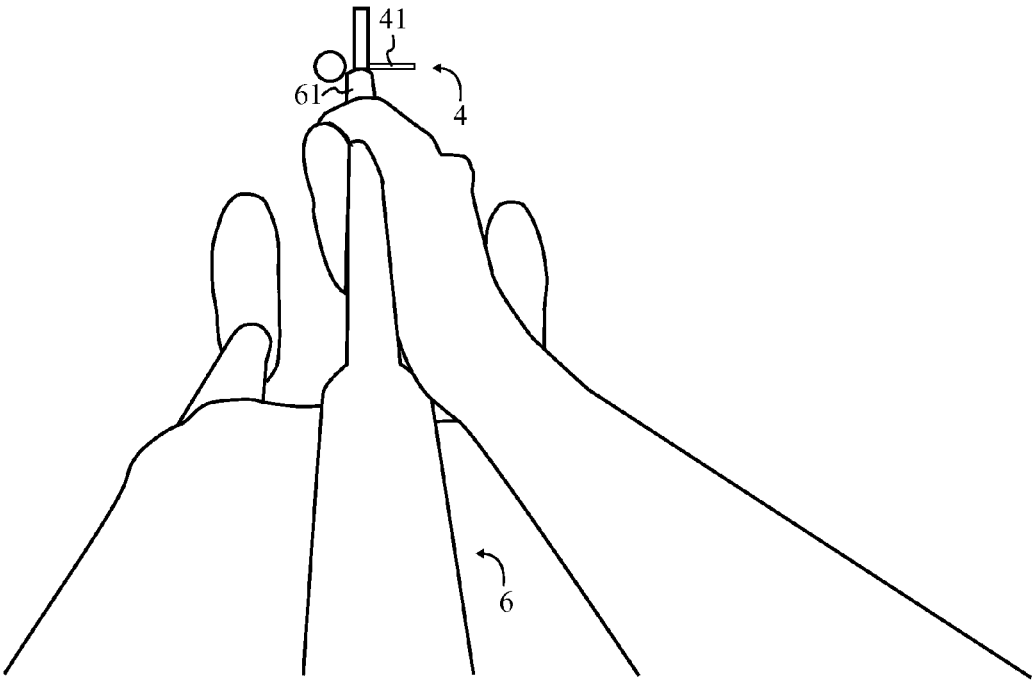
FIG. 15 is an image showing the present invention indicating a proper putting stance.
Figure 16:
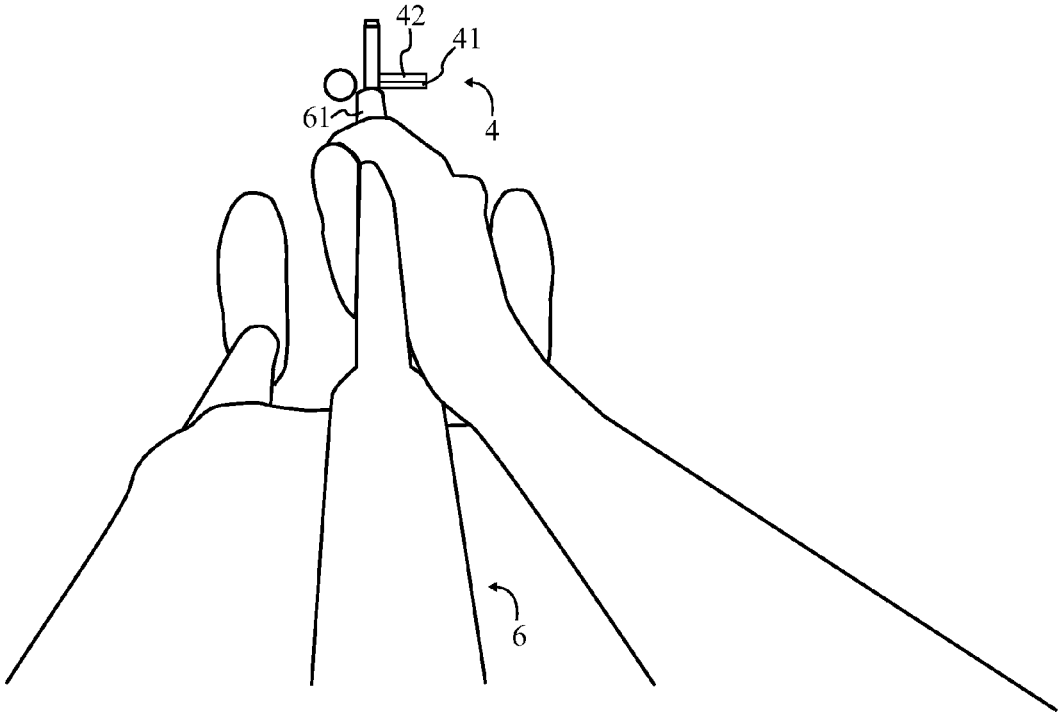
FIG. 16 is an image showing the present invention indicating a putting stance which is too close to the ball.
Figure 17:
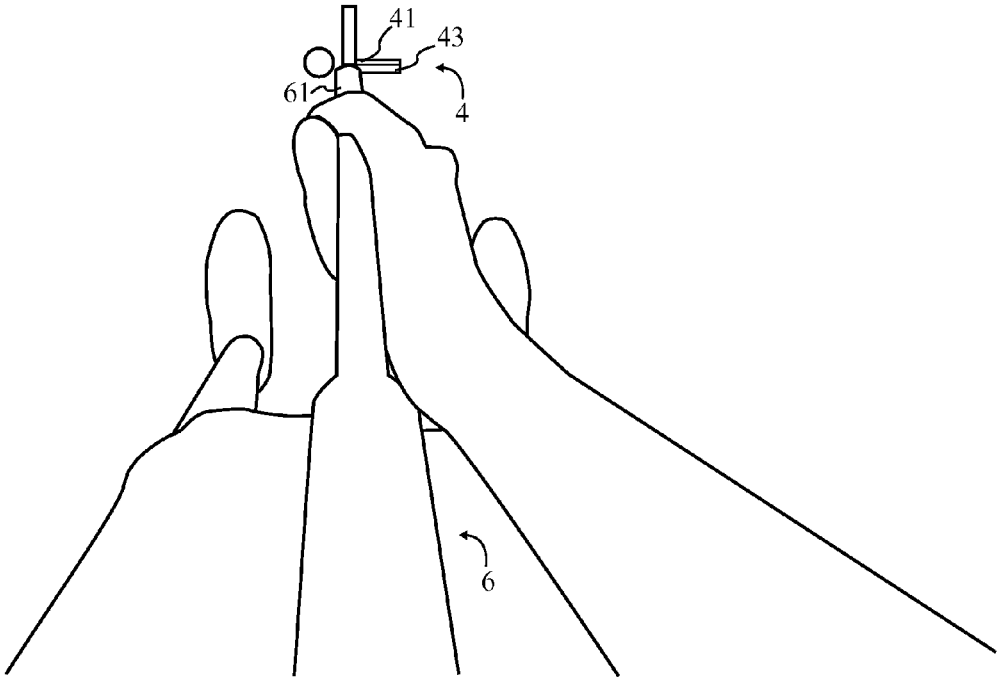
FIG. 17 is an image showing the present invention indicating a putting stance which is too far from the ball.

Once the clip 1 has been used to attach the present invention to the shaft 61, the mount 3 is adjusted so that the arm 2 is centered in relation to the head of the putter. This is enabled by the engagement of the mount 3 to the track 22, which allows the mount 3 to slide along the track 22. Using this functionality of the present invention, a golfer is able to center the arm 2 in relation to the head. With the arm 2 centered, the golfer can then use the indicator block 4 to gauge their distance from the ball, as subsequently described. Since the indicator block 4 is capable of rotating, gravity will insure that the top face 41 of the indicator block 4 always faces directly upwards, even when standing on hills, bunkers, or other inclines and uneven surfaces. This allows the top face 41 to be used a positive feedback indicator 411; if a golfer is standing the proper distance from the ball, they should only see the top face 41, and the corresponding first color 412. An example of the proper stance distance is depicted in FIG. 15. If the golfer is standing too close or too far from the ball, they will see either the first lateral face 42 or second lateral face 43, as well as the corresponding second color 422 or third color 433. FIG. 16 illustrates the view when a golfer stands too close to the ball, while FIG. 17 illustrates what a golfer sees when standing too far from the ball. The first negative feedback indicator 421 and second negative feedback indicator 431 thus provide a visual cue that the golfer needs to move closer to or away from the golf club 6, until only the first color 412 on the top face 41 is visible. Ideally, the arm 2 is oriented so that the first negative feedback indicator 421 is a cue that the golfer is too close to the ball while the second negative feedback indicator 431 is a cue that the golfer is too far from the ball. In the preferred embodiment, the first color 412 (used for the top face 41) is green, the second color 422 (used for the first lateral face 42) is yellow, and the third color 433 (used for the second lateral face 43) is red. The above indicators apply from the viewpoint of a right-handed golfer. While a separate version can be manufactured for left-handed golfers, in which the colors on the first lateral face 42 and second lateral face 43 are switched, the right-handed version can still be used by left-handed golfers. The only difference is that, in this left-handed scenario, the first negative feedback indicator 431 is a cue that the golfer is too far from the ball and the second negative feedback indicator 431 is a cue that the golfer is too close to the ball.

While the preferred embodiment describes a clip 1 that attaches the present invention to a golf club 6, the key functionality of the present invention is the gravity-induced oscillation of the indicator block 4 about the rod 32 and the translational movement of the mount 3 along the track 22. These capabilities are important as they allow the indicator block 4 to be centered with the head of the club, as well as rotate when the golfer is standing on non-flat surfaces such that the indicator block 4 still properly indicates whether the golfer's stance is too close, too far, or the correct distance from the ball. In other embodiments, the present invention can utilize different components to attach to the shaft 61 of the golf club 6, or even be directly attached to the head. For example, if the mount 3 is attached directly to the head, the clip 1 and the arm 2 would become unnecessary as the mount 3 would be centered as it's connected, negating the need for adjustments along the track 22. To attach the mount 3 to the head, matching hook-and-loop fasteners could be placed on the top of the head and on a bracket of the mount 3. Alternatively, the mount 3 could be magnetized, allowing it to attach to metallic heads. As long as these and other attachment methods allow the indicator block 4 to oscillate about the rod 32 and be centered in relation to the head, a number of variations on the preferred embodiment can be implemented.

Although the invention has been explained in relation to its preferred embodiment, it is to be understood that many other possible modifications and variations can be made without departing from the spirit and scope of the invention as hereinafter claimed.

What is claimed is:

1. A golf stance indicator comprises:
a clip;
an arm;
a mount;
an indicator block;
the clip comprises a web, a first jaw, and a second jaw;
the arm comprises a floor, a track, and a stop;
the mount comprises a carriage and a rod;
the indicator block comprises a top face, a first lateral face, a second lateral face, and a channel;
the arm being bistably connected to the clip;
the track being positioned along the arm;
the rod being adjacently connected to the carriage;
the carriage being slidably engaged with the track; and
the indicator block being rotatably connected to the carriage by the rod.

2. The golf stance indicator as claimed in claim 1 comprises:
the first jaw and the second jaw being positioned opposite each other across the web, wherein the first jaw and the second jaw clamp the clip to a shaft of a golf club; and
the first jaw and the second jaw being adjacently connected to the web.

3. The golf stance indicator as claimed in claim 1 comprises:
the track comprises a first rail and a second rail;
the track being adjacently connected along the floor;
the first rail being positioned along the track;
the second rail being positioned along the track;
the first rail and the second rail being positioned opposite each other across the track;
the stop being adjacently connected to the track;
the clip being positioned opposite the stop along the track; and
the clip being positioned adjacent to the floor opposite the track.

4. The golf stance indicator as claimed in claim 1 comprises:
a spring loaded axle;
the clip further comprises a first ridge and a second ridge;
the arm further comprises a first notch and the second notch;
the spring loaded axle traversing through the floor into the web;
the first ridge and the second ridge being adjacently connected to the web opposite the first jaw and the second jaw;
the first ridge and the second ridge being laterally positioned around the spring-loaded axle;
the first ridge and the second ridge being perpendicular to the first jaw and the second jaw;
the first notch and the second notch being adjacently connected to the floor opposite the track;
the first notch and the second notch being laterally positioned around the spring-loaded axle; and
the first notch and the second notch being parallel to the track.

5. The golf stance indicator as claimed in claim 4 comprises:
the first ridge and the second ridge being positioned opposite each other around the spring-loaded axle;
the first ridge and the second ridge being perpendicular to the spring-loaded axle;
the first notch and the second notch being positioned opposite each other around the spring-loaded axle;
the first notch and the second notch being perpendicular to the spring-loaded axle; and
the first ridge being engaged with the first notch and the second ridge being engaged with the second notch.

6. The golf stance indicator as claimed in claim 1 comprises:
the first lateral face and the second lateral face being positioned opposite each other across the top face;
the first lateral face and the second lateral face being positioned perpendicular to the top face;
the channel being positioned in between the first lateral face and the second lateral face; and
the channel being positioned adjacent to the top face.

7. The golf stance indicator as claimed in claim 1 comprises:
the mount further comprises a spacer and a cap;
the rod being positioned perpendicular to the track;
the rod traversing through the channel;
the spacer encircling the rod adjacent to the carriage;
the cap being positioned opposite the spacer along the rod;
the cap being attached to the rod; and
the indicator block being positioned between the spacer and the cap.

8. The golf stance indicator as claimed in claim 1 comprises:
the top face being a positive feedback indicator, wherein the top face is a first color;
the first lateral face being a first negative feedback indicator, wherein the first lateral face is a second color; and
the second lateral face being a second negative feedback indicator, wherein the second lateral face is a third color.

9. A golf stance indicator comprises:
a clip;
an arm;
a mount;
an indicator block;
a spring loaded axle;
the clip comprises a web, a first jaw, a second jaw, a first ridge, and a second ridge;
the arm comprises a floor, a track, a stop, a first notch, and a second notch;
the track comprises a first rail and a second rail;
the mount comprises a carriage and a rod;

the indicator block comprises a top face, a first lateral face, a second lateral face, and a channel;
the arm being bistably connected to the clip;
the track being positioned along the arm;
the track being adjacently connected along the floor;
the rod being adjacently connected to the carriage;
the carriage being slidably engaged with the track;
the indicator block being rotatably connected to the carriage by the rod;
the first lateral face and the second lateral face being positioned opposite each other across the top face;
the channel being positioned in between the first lateral face and the second lateral face; and
the rod being positioned perpendicular to the track.

10. The golf stance indicator as claimed in claim 9 comprises:
the first jaw and the second jaw being positioned opposite each other across the web, wherein the first jaw and the second jaw clamp the clip to a shaft of a golf club; and
the first jaw and the second jaw being adjacently connected to the web.

11. The golf stance indicator as claimed in claim 9 comprises:
the first rail being positioned along the track;
the second rail being positioned along the track;
the first rail and the second rail being positioned opposite each other across the track;
the stop being adjacently connected to the track;
the clip being positioned opposite the stop along the track; and
the clip being positioned adjacent to the floor opposite the track.

12. The golf stance indicator as claimed in claim 9 comprises:
the spring loaded axle traversing through the floor into the web;
the first ridge and the second ridge being adjacently connected to the web opposite the first jaw and the second jaw;
the first ridge and the second ridge being laterally positioned around the spring-loaded axle;
the first ridge and the second ridge being positioned opposite each other around the spring-loaded axle;
the first ridge and the second ridge being perpendicular to the first jaw and the second jaw;
the first ridge and the second ridge being perpendicular to the spring-loaded axle;
the first notch and the second notch being adjacently connected to the floor opposite the track;
the first notch and the second notch being laterally positioned around the spring-loaded axle;
the first notch and the second notch being positioned opposite each other around the spring-loaded axle;
the first notch and the second notch being parallel to the track;
the first notch and the second notch being perpendicular to the spring-loaded axle; and
the first ridge being engaged with the first notch and the second ridge being engaged with the second notch.

13. The golf stance indicator as claimed in claim 9 comprises:
the first lateral face and the second lateral face being positioned perpendicular to the top face; and
the channel being positioned adjacent to the top face.

14. The golf stance indicator as claimed in claim 9 comprises:
the mount further comprises a spacer and a cap;
the rod traversing through the channel;
the spacer encircling the rod adjacent to the carriage;
the cap being positioned opposite the spacer along the rod;
the cap being attached to the rod; and
the indicator block being positioned between the spacer and the cap.

15. The golf stance indicator as claimed in claim 9 comprises:
the top face being a positive feedback indicator, wherein the top face is a first color;
the first lateral face being a first negative feedback indicator, wherein the first lateral face is a second color; and
the second lateral face being a second negative feedback indicator, wherein the second lateral face is a third color.

16. A golf stance indicator comprises:
a clip;
an arm;
a mount;
an indicator block;
a spring loaded axle;
the clip comprises a web, a first jaw, a second jaw, a first ridge, and a second ridge;
the arm comprises a floor, a track, a stop, a first notch, and a second notch;
the track comprises a first rail and a second rail;
the mount comprises a carriage, a rod, a spacer, and a cap;
the indicator block comprises a top face, a first lateral face, a second lateral face, and a channel;
the arm being bistably connected to the clip;
the track being positioned along the arm;
the track being adjacently connected along the floor;
the first jaw and the second jaw being positioned opposite each other across the web, wherein the first jaw and the second jaw clamp the clip to a shaft of a golf club;
the first jaw and the second jaw being adjacently connected to the web;
the first rail and the second rail being positioned opposite each other across the track;
the first ridge and the second ridge being laterally positioned around the spring-loaded axle;
the first notch and the second notch being adjacently connected to the floor opposite the track;
the first notch and the second notch being laterally positioned around the spring-loaded axle;
the first lateral face and the second lateral face being positioned perpendicular to the top face;
the rod being adjacently connected to the carriage;
the carriage being slidably engaged with the track;
the indicator block being rotatably connected to the carriage by the rod;
the rod traversing through the channel;
the first lateral face and the second lateral face being positioned opposite each other across the top face;
the channel being positioned in between the first lateral face and the second lateral face;
the channel being positioned adjacent to the top face;
the rod being positioned perpendicular to the track;
the spring loaded axle traversing through the floor into the web; and
the first ridge and the second ridge being adjacently connected to the web opposite the first jaw and the second jaw.

17. The golf stance indicator as claimed in claim 16 comprises:
the first rail being positioned along the track;
the second rail being positioned along the track;
the stop being adjacently connected to the track;

the clip being positioned opposite the stop along the track; and the clip being positioned adjacent to the floor opposite the track.

18. The golf stance indicator as claimed in claim 16 comprises:

the first ridge and the second ridge being positioned opposite each other around the spring-loaded axle;

the first ridge and the second ridge being perpendicular to the first jaw and the second jaw;

the first ridge and the second ridge being perpendicular to the spring-loaded axle;

the first notch and the second notch being positioned opposite each other around the spring-loaded axle;

the first notch and the second notch being parallel to the track;

the first notch and the second notch being perpendicular to the spring-loaded axle; and the first ridge being engaged with the first notch and the second ridge being engaged with the second notch.

19. The golf stance indicator as claimed in claim 16 comprises:

the spacer encircling the rod adjacent to the carriage;

the cap being positioned opposite the spacer along the rod;

the cap being attached to the rod; and the indicator block being positioned between the spacer and the cap.

20. The golf stance indicator as claimed in claim 16 comprises:

the top face being a positive feedback indicator, wherein the top face is a first color;

the first lateral face being a first negative feedback indicator, wherein the first lateral face is a second color; and the second lateral face being a second negative feedback indicator, wherein the second lateral face is a third color.

* * * * *